US005657773A

United States Patent [19]

George

[11] Patent Number: 5,657,773

[45] Date of Patent: Aug. 19, 1997

[54] CIGARETTE ROLLING PAPER WITH ROLLING ASSIST

[76] Inventor: Nadim William George, 617 E. Angeleno Ave., Suite 307, Burbank, Calif. 91501

[21] Appl. No.: 570,976

[22] Filed: Dec. 12, 1995

[51] Int. Cl.[6] ..... A24D 1/02

[52] U.S. Cl. ..... 131/365; 131/331; 131/260

[58] Field of Search ..... 131/365, 268, 131/15 R, 331

[56] References Cited

U.S. PATENT DOCUMENTS

| | | | |
|---|---|---|---|
| 1,257,815 | 2/1918 | Courtinade | 131/365 |
| 1,289,975 | 12/1918 | Waddell | 131/365 |
| 3,543,769 | 12/1970 | Arthur | 131/268 |
| 4,033,358 | 7/1977 | Harrington | 131/260 |
| 4,114,629 | 9/1978 | Sedlacek et al. | 131/15 |
| 4,747,418 | 5/1988 | Veluz | 131/331 |

*Primary Examiner*—Vincent Millin
*Assistant Examiner*—Charles W. Anderson
*Attorney, Agent, or Firm*—Christie, Parker & Hale, LLP

[57] ABSTRACT

A cigarette rolling paper includes a rectangular sheet of cigarette paper having a frontside surface and a backside surface. A rectangular strip of deformable material is attached at one end to the frontside surface of the sheet. The strip is positioned on the sheet with its length extending across the width of the sheet, and with a lengthwise edge positioned adjacent a widthwise side edge of the sheet. The strip includes a free end opposite from an attached end that preferably extends a distance beyond a lengthwise edge of the sheet opposite from the adhesive section. The strip is rolled into a spiral configuration before placing smoking material into the sheet to assist the user in rolling by hand a substantially cylindrical cigarette. The rolled strip also prevents smoking material from being drawn through the cigarette and into a user's mouth, and permits the entire amount of smoking material to be consumed without risking burned hands and/or lips.

11 Claims, 3 Drawing Sheets

CIGARETTE ROLLING PAPER WITH ROLLING ASSIST

FIELD OF THE INVENTION

The present invention relates generally to cigarette rolling papers and, more particularly, to a cigarette rolling paper having a rolling assist that serves to facilitate hand rolling of the paper, and that additionally serves as both a filter and a holder when the cigarette is rolled and smoked.

BACKGROUND OF THE INVENTION

Conventionally, cigarette rolling papers are made from thin, tissue-like paper having a quadrilateral shape with sides of between one and four inches in length, and usually between 2.5 to 3.5 inches in length.

When using such conventionally shaped cigarette rolling paper to make or roll a cigarette by hand, the paper is first folded, bent or held in somewhat of a V-shape or U-shape with one of the sides of the "V" or "U" being longer than the other. An amount of smoking material, such as tobacco or the like, is distributed substantially over the entire length of the rolling paper in the bottom of the V- or U-shaped pouch formed by the rolling paper. The longer portion of the rolling paper, being free of any of the smoking material, is then bent or rolled over the portion of the rolling paper covered with the tobacco and is rolled over upon itself to form a substantially cylindrical shape. The longer end of the rolling paper is wrapped around itself as far as possible and overlaps an underlying layer to form part of the wall of the cylinder.

The rolling process, when performed by hand, requires a keen eye, a steady hand, and a high degree of digital dexterity, since the rolling paper is not very large compared to a human hand, since the particles of smoking materials tend to roll or slide off the small rolling paper, and since the rolling paper itself is very thin and easily ripped or torn. A critical step of rolling a cigarette by hand is using ones fingers to both form the "V" or "U" shaped pouch for the smoking material, and to roll the longer portion of the rolling paper around itself. During the process of rolling the longer portion of the paper around itself, the user depends on the trapped smoking material to provide the generally cylindrical shape to guide placement of the longer portion around itself to produce a generally cylindrical cigarette.

Oftentimes, however, the use of smoking material to guide placement of the longer portion around itself does not aid in producing a cylinder due to either poor distribution of smoking material along the V- or U-shaped pouch, causing the longer portion to be rolled too tight or too loose around itself, with respect to the majority portion of the smoking material, or due simply to the user's inability to correctly manipulate or spiral the cigarette rolling paper around itself between their fingers. The result of either of these situations can be an unsmokable cigarette, a cigarette that falls apart, or a cigarette that is torn, which also has the effect of making the cigarette unsmokable.

Cigarettes that are rolled by hand using conventional cigarette rolling paper do not include filters or other means for preventing the smoking material from being drawn into the users mouth. One method that is used to prevent smoking material from being drawn into a users mouth has been to restrict the size of the opening by pinching or twisting the end of the rolling paper upon itself. While this method is somewhat effective at reducing passage of smoking material from the cigarette, it also restricts the amount of air that can be drawn through the cigarette, and this restricts consumption of the smoking material. Restricting the cigarette air passage also requires a larger effort by the smoker that reduces smoking pleasure.

Cigarettes that are rolled using conventional cigarette rolling paper also do not permit complete use of the smoking material disposed within because the cigarette can only be smoked until the lit end approaches the user's fingers or lips during holding or smoking, the cigarette must be dispensed, and at which time a user's fingers or lips may be burned.

It is, therefore, desirable that a cigarette rolling paper be constructed in a manner that assists the user in rolling a cigarette by hand. It is desirable that the cigarette rolling paper be constructed in a manner that prevents smoking material from being drawn from the cigarette into a smoker's mouth. It is also desirable that the cigarette rolling paper be constructed in a manner that permits the entire smoking material to be smoked without the risk of burned fingers or burned lips. It is further desirable that the cigarette rolling paper be constructed from conventional materials using conventional techniques.

SUMMARY OF THE INVENTION

There is, therefore, provided in the practice of this invention a cigarette rolling paper comprising a sheet of cigarette paper having a frontside surface and a backside surface. The sheet can be a conventional cigarette paper of rectangular configuration, having an adhesive section or strip extending lengthwise along an edge of the frontside surface. The cigarette rolling paper includes a means attached to the frontside surface of the sheet for assisting in the formation of a substantially cylindrical cigarette by hand.

The means for assisting formation of a substantially cylindrical cigarette is preferably in the form of a strip of deformable material that is attached at one end to the frontside surface of the sheet. The strip is preferably of rectangular configuration and is positioned on the sheet with its length extending across the width of the sheet, and with a lengthwise edge positioned adjacent a widthwise side edge of the sheet. The strip includes a free end opposite from an attached end that preferably extends a distance beyond a lengthwise edge of the sheet opposite from the adhesive section.

A cigarette is formed by rolling the free end of the strip about itself into a spiral, and bending the sheet around the rolled strip to form a U-shaped pouch. Smoking material is disposed within the pouch and the sheet is rolled over the rolled strip and smoking material so that its backside surface interfaces with its frontside surface to form a cylinder. The adhesive section is activated and sealed against the backside sheet surface to form a cylindrical cigarette.

The rolled strip: (1) assists the user in forming a cylindrical cigarette; (2) prevents smoking material from being drawn through the cigarette and into a user's mouth; and (3) permits the entire amount of smoking material to be consumed without risking burned hands and/or lips.

BRIEF DESCRIPTION OF THE DRAWINGS

These and other features and advantages of cigarette rolling papers, constructed according to principles of this invention, will become appreciated as the same becomes better understood with reference to the specification, claims and drawings wherein:

FIG. 3 is a perspective view of the preferred embodiment of the cigarette rolling paper of FIG. 1, illustrating the rolling strip rolled into a spiral;

FIG. 4 is a perspective view of the preferred embodiment of the cigarette rolling paper of FIG. 1, illustrating formation of U-shaped pouch around the rolling strip;

FIG. 5 is a perspective view of the preferred embodiment of the cigarette rolling paper of FIG. 1, illustrating a completed cigarette.

DETAILED DESCRIPTION

This invention relates to cigarette rolling papers having an improved construction that: (1) facilitates rolling a cigarette into a cylinder by hand; (2) prevents smoking material from being drawn into a user's mouth; and (3) permits the entire smoking material to be smoked without the risk of burned fingers or burned lips.

Figure 1:
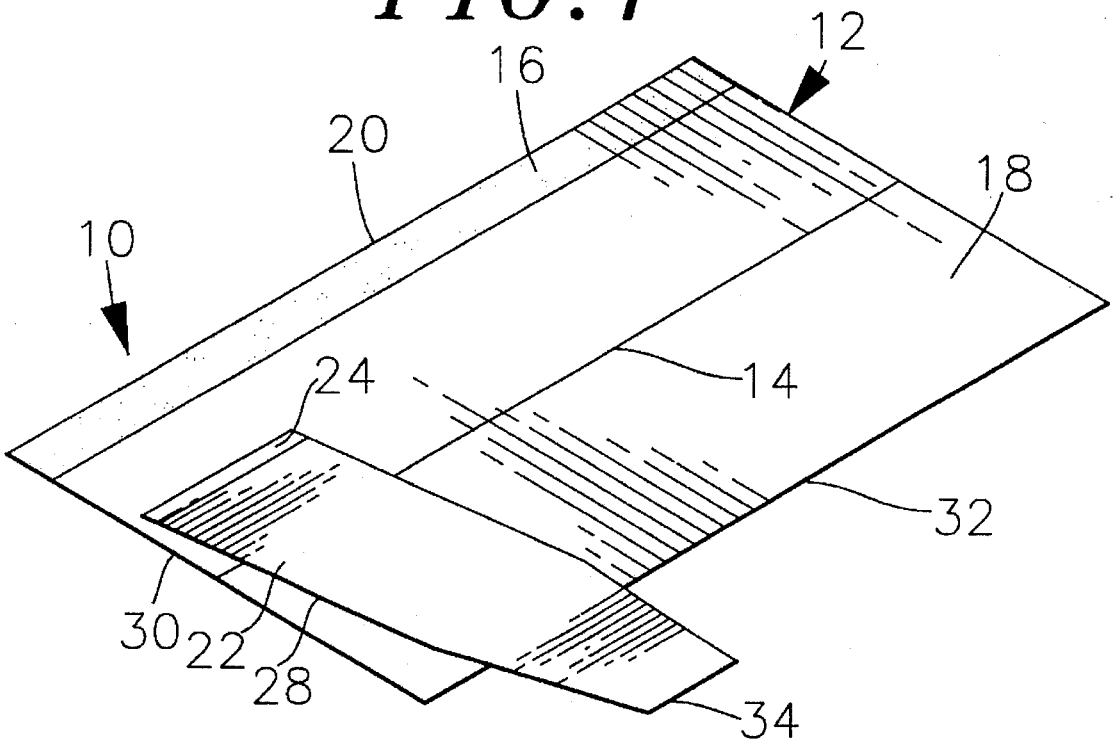
FIG. 1 is a perspective view of a preferred embodiment of a cigarette rolling paper that illustrates a rolling strip in an extended position.

Referring to FIG. 1, a cigarette rolling paper 10, constructed according to principles of this invention, comprises a rectangular sheet of cigarette paper 12. The sheet of paper 12 is formed of conventional smoking paper of appropriate thickness, dimension and composition. It is to be understood that the sheet 12 can be formed of conventional cigarette paper that is bleached or nonbleached, that is flavored or nonflavored. The rectangular sheet 12 can have a length consistent with conventional cigarette paper sheets, e.g., in the range of from about one to four inches. In example cigarette rolling paper embodiments, the sheet 12 dimensions are 2.75 inches by 1.5 inches, and 3 inches by 2 inches. It is, however, to be understood that these dimensions are provided for purposes of reference and illustration, and can be other than that specifically described.

The sheet 12 includes a fold 14 that extends lengthwise or parallel along a length of the sheet and is positioned near a midpoint of the sheet width. The fold 14 is used to facilitate packaging and storage of the cigarette rolling paper in a conventional box-type dispenser. The sheet 12 includes a section or strip of adhesive, glue or moisture-activated gum 16 disposed on a frontside sheet surface 18 at a position adjacent a first edge 20 of the sheet that extends lengthwise or parallel along the length of the sheet. The adhesive section 16 extends a distance from the first edge 20 toward the fold 14. In a preferred embodiment, the adhesive section 16 has a width of approximately 3/16 inches, i.e., extends away from the first end approximately 3/16 inches, and is formed from a moisture-activated gum.

A rolling assist in the form of a strip 22 is attached to the frontside surface 18 of the cigarette rolling sheet 12 at a location between the first edge 18 and the fold 14. The rolling strip 22 is formed from a pliable and deformable material, such as paper, plastic, metal and the like, that is capable of retaining a spiral shape when rolled upon itself from one end. In a preferred embodiment, the rolling strip is formed from a material is relatively less flammable than the cigarette rolling sheet and/or the smoking material so that when all of the smoking material has been consumed the cigarette becomes extinguished. In an example embodiment, the rolling strip 22 is formed from paper, having a thickness greater than the thickness of the cigarette rolling sheet 12.

The rolling strip 22 is configured in the shape of a rectangular strip having a width, that is aligned parallel with the length of the sheet 12, and having a length that is aligned parallel with the width of the sheet 12. The rolling strip 22 is attached to the frontside surface 18 of the sheet 12 at a base 24 that defines a first end of the strip. It is desired that the base 24 be attached to the sheet, at a position widthwise or along the width of the sheet, a distance away from the first edge 20, between the adhesive section 16 and the fold 14. It is desired that the base 24 be attached to the sheet so that a lengthwise edge 28 of the strip is coterminous with a widthwise edge 30 of the sheet when the strip is laid flat against the sheet.

It is desired that the width of the rolling strip be sufficient so that, when rolled to assist in forming the rolled cigarette, it provides a sufficient distance between a tip of the cigarette and the smoking material to prevent ones fingers or lips from being burned during holding or smoking the cigarette. Accordingly, the selected width of the rolling strip reflects a compromise between the amount of distance desired to protect against burned fingers or lips, the amount of distance useful in providing assistance in rolling the cigarette, and further the amount of smoking material that one desires to consume.

The rolling strip 22 has a length that, when attached to the sheet, causes a free end to extend a distance beyond a second edge 32 of the sheet that is opposite to the adhesive strip. The rolling strip 22 has a width that is preferably less than one half of the sheet length. It is desired that the rolling strip have a free end 34, opposite from the base 24, that extends beyond the second edge 32 of the sheet to permit a user to grasp the free end and roll the strip upon itself independent of the sheet, as discussed in greater detail below. It is also important that the rolling strip have a sufficient width to assist or guide the user in rolling the sheet upon itself into a cylinder, as discussed in greater detail below. The distance that the free end 34 extends from the second edge 32 of the sheet is in part defined by the attachment point of the base 24 on the sheet.

In a preferred embodiment, it is desired that the base 24 be attached to the sheet 12 at a point along the width of the sheet that is approximately midway between the first edge 20 and the fold 14, and that the free end 34 extend in the range of from 0.1 to 1 inches beyond the second edge 32. In an example embodiment, comprising a sheet 12 having a length of approximately 2.75 inches and a width of approximately 1.5 inches, the rolling strip is approximately 0.75 inches wide by 1.25 inches long. In such example embodiment, the base portion 24 of the rolling strip 22 is attached to the frontside surface of the sheet 12 approximately 0.5 inches from the first edge 18, so that the free end 34 extends approximately 0.25 inches beyond the second edge 32 of the sheet. In another example embodiment, comprising a sheet 12 having a length of approximately 3 inches and a width of approximately 2 inches, the rolling strip is approximately 0.75 inches wide by 1.75 inches long. In such example embodiment, the base portion 24 of the rolling strip 22 is attached to the frontside surface of the sheet 12 approximately 0.5 inches from the first edge 18, so that the free end 34 extends approximately 0.25 inches beyond the second edge 32 of the sheet.

As shown in FIG. 1, the rolling strip can be configured having a free end 34 that is tapered inwardly or that has cut corners. Although a tapered free end 34 is not necessary, an inwardly tapered construction moving toward the free end facilitates rolling the strip upon itself into a spiral by a user, i.e., is easy rolling. In a tapered embodiment of the rolling strip 22, it is desired that the taper begin at a position greater between the middle of the stip length and the free end 34, and taper to a width at the free end that is sufficient to permit a user to roll the free end upon itself into a spiral. For example, in the example embodiments described above, the rolling strip is tapered to a width at the free end 34 of approximately 0.25 inches.

Figure 2:
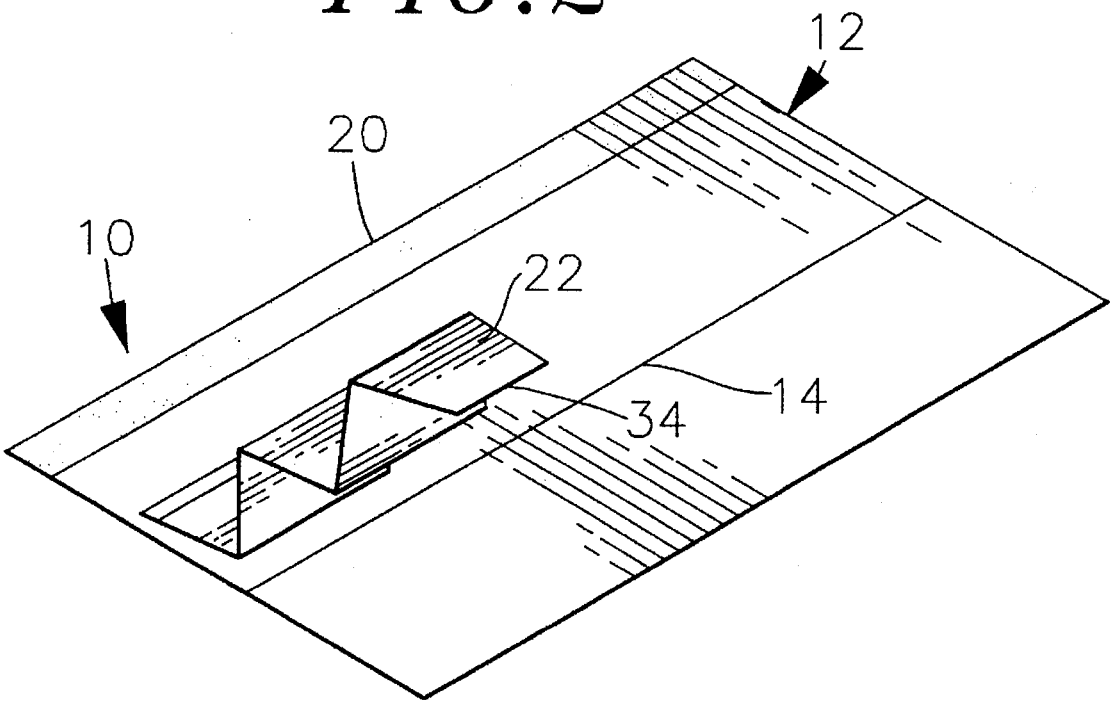
FIG. 2 is a perspective view of the preferred embodiment of the cigarette rolling paper of FIG. 1, illustrating the rolling strip in a retracted position.

Referring to FIG. 2, the rolling strip 22 is folded upon itself within a half width of the rolling sheet 12 between the first edge 20 and the fold 14 to facilitate packaging and storage in a conventional box-type cigarette rolling paper dispenser. The number of times that the rolling strip is folded upon itself depends both on the length of the rolling strip and on the attachment position of the base 24. In a preferred embodiment, is desired that the rolling strip be folded a minimum amount of times to reduce the thickness associated with the folded rolling sheet and, thereby maximize the number of cigarette rolling papers that can be packaged and stored within a dispenser. As discussed below, the dispenser includes enlarged or cut-out openings that permit dispensement of the cigarette rolling papers of this invention using a box-type cigarette rolling paper dispenser.

Figure 3:
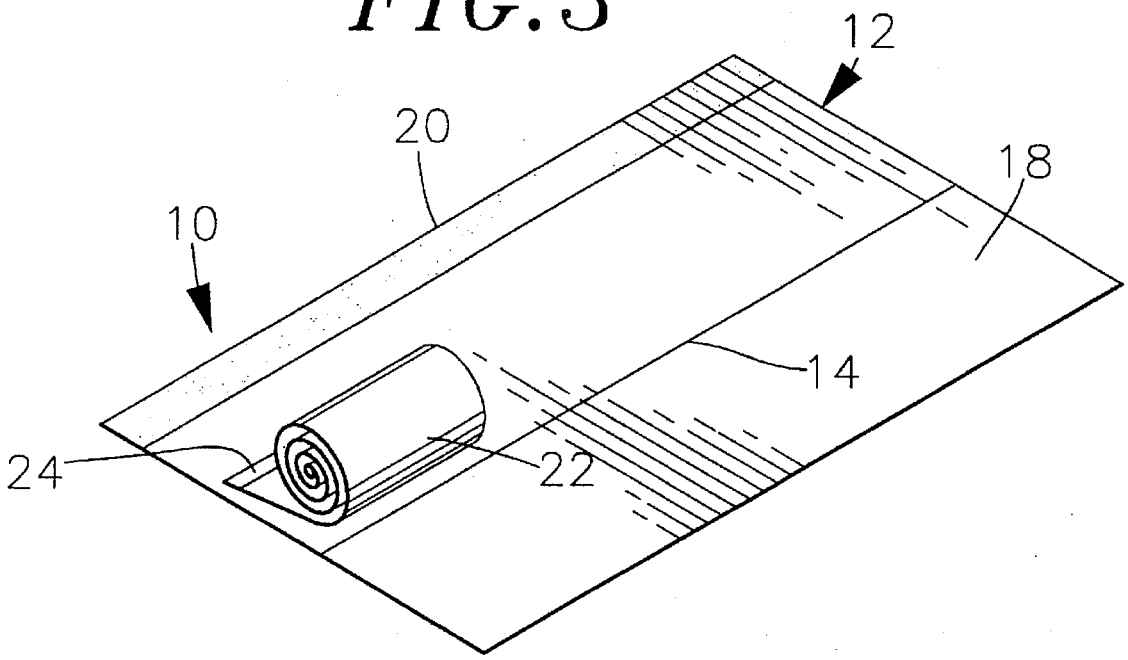
FIGS. 3–5 are perspective views of the preferred embodiment of the cigarette rolling paper of FIG. 1, illustrating use of the cigarette rolling paper to roll a cigarette, specifically.

Cigarette rolling papers, constructed according to principles of this invention are used to facilitate hand rolling of a cigarette in the following manner. The cigarette rolling paper is withdrawn from a dispenser the rolling strip 22 is unfolded outwardly away from its attachment point with the rolling sheet 12, and is straightened. The free end 34 of the rolling strip 22 is placed between a users thumbs and forefingers and is rolled in an upward direction upon itself toward the first edge 20 of the sheet 12 to form a spiral, as shown in FIG. 3. The rolling strip is rolled upon itself until the attachment point between the base 24 of the rolling strip and the sheet 12 is reached. The act of rolling the strip is stopped when the attachment point is reached, or when a light resistance to rolling is detected by the user, whichever is first. It is important that during the act of rolling the strip the strip does not become detached from the sheet.

Figure 4:
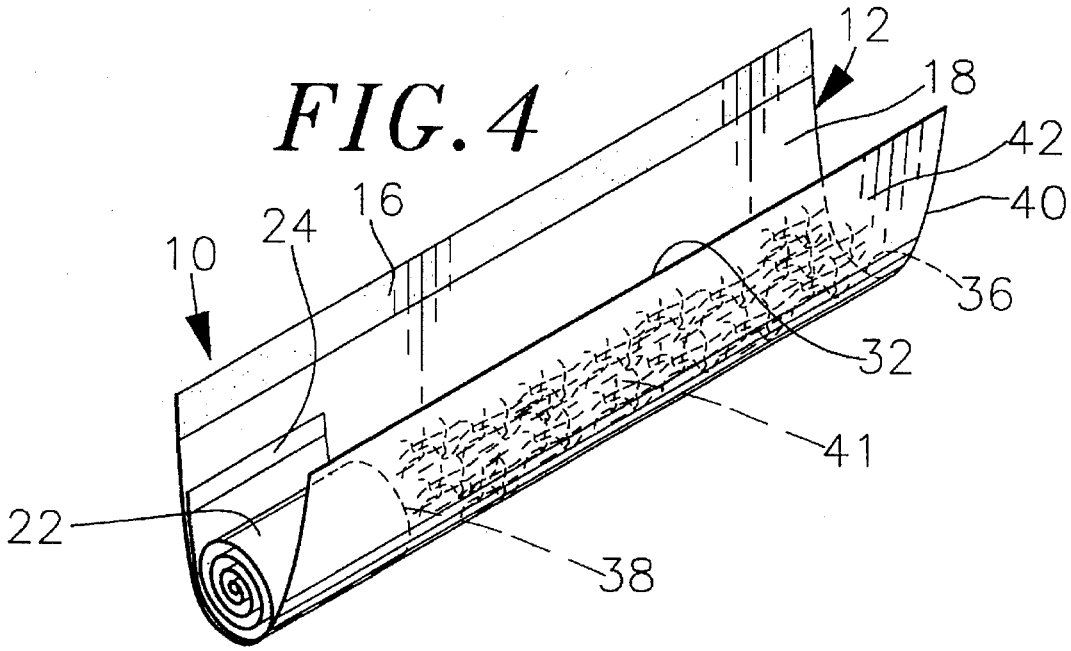

It is desired that the rolling strip be rolled a distance toward the first edge 20 to a position along frontside surface of the sheet 12 where the user desires to form a pouch from the sheet to hold the smoking material. Preferably, the rolling strip is rolled along the sheet to a position adjacent the fold 14. Referring to FIG. 4, when the rolling strip 22 is positioned in this manner, the cigarette rolling sheet 12 is rolled or bent around an outside surface of the rolled rolling strip 22 to form a U-shaped or V-shaped pouch 36 extending axially from an end 38 of the rolled rolling strip 22 to a widthwise edge 40 of the sheet. During this step, the rolled rolling strip 22 acts as a guide to assist the user in forming a generally U-shaped pouch not only along the section of the sheet that is placed into direct contact with the outside surface of the rolling strip, but along the entire length of the sheet. The ability to form a generally U-shaped pouch is desired as it increases the user's ability to form a cigarette having a substantially cylindrical configuration.

Smoking material 41 is placed within the pouch 36 between the end 38 of the rolled rolling strip 22 and the widthwise edge 40 of the sheet. It is desired that the amount of smoking material placed within the pouch be sufficient to permit the formation of a cylinder therefrom of uniform distribution that has a diameter approximately equal to that of the rolled rolling strip. Once the desired amount of smoking material is placed into the pouch, the user uses the rolled rolling strip as a guide to roll the second edge 32 of the sheet around both the rolled rolling strip and the volume of smoking material. Acting in this manner, the rolled rolling strip 22 assists the user in rolling the sheet in substantially cylindrical form.

Figure 5:
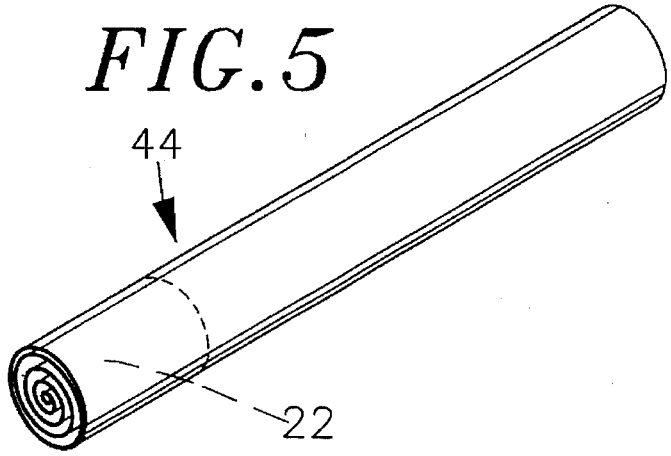

The step of rolling the second edge 32 of the sheet around the rolled rolling strip 22 and smoking material is continued so that the second edge 32 of the sheet becomes tucked between the frontside sheet surface 18, on one side, and the rolled rolling strip 22 and smoking material, on an opposite side. A backside surface 42 of the sheet 12 interfaces with and is rolled against the frontside sheet surface 18 about the rolled rolling strip 22 and the smoking material, and toward the first edge 20 until only the adhesive section 16 remains exposed. During the entire process of rolling the cigarette rolling paper, the rolled rolling strip acts as a guide that is used between the fingers of a user to assist in the formation of a cylinder. The adhesive section 16 is activated by suitable means, e.g., if the adhesive section is a moisture-activated gum it is activated by licking, and rolling of the cigarette rolling paper is continued so that the adhesive section is sealed against an adjacent backside sheet surface 42 to form a cylindrical cigarette, 44 as shown in FIG. 5.

The diameter of the cigarette that is rolled using cigarette rolling papers of this invention vary depending on such factors as the type and thickness of material selected to form the rolling strip, the length of the rolling strip, the point where the rolling strip is attached to the cigarette rolling sheet, and the type and amount of smoking material that is used.

A key feature of cigarette rolling paper, constructed according to principles of this invention is, that it includes an internal means for assisting the user to form a substantially cylindrical cigarette without the need to resort to external rolling means, such as manual or electric rolling machines and the like. Accordingly, use of cigarette rolling papers of this invention enables a user to build a cylindrical cigarette by hand without additional devices.

Figure 6:
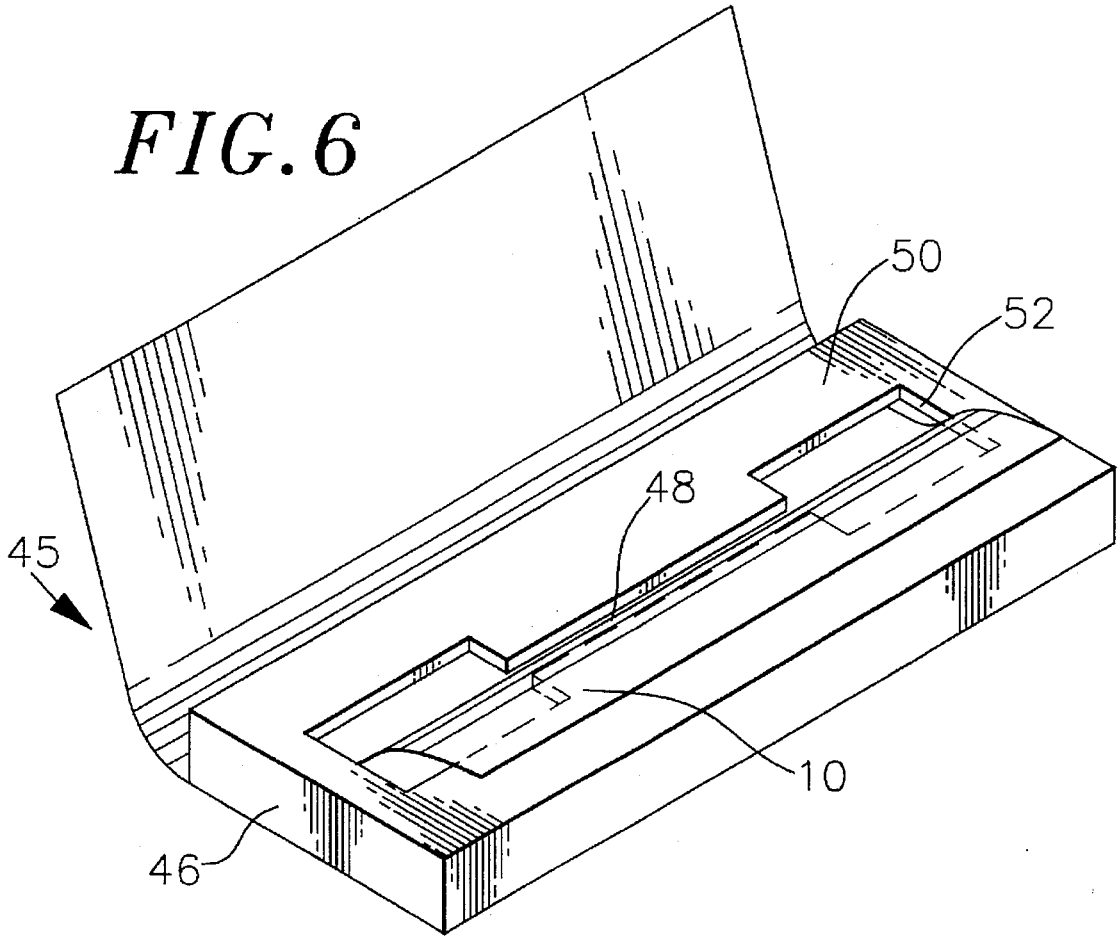
FIG. 6 is a perspective view of a dispenser used to contain and dispense a quantity of the preferred cigarette rolling papers of FIG. 1.

Referring to FIG. 6, cigarette rolling papers of this invention can be stored and packaged in a cigarette rolling paper dispenser 45 having a rectangular box-shaped housing 46 and having a single dispensement slot or opening 48. The dispenser slot 48 is extends through a middle portion of a frontside surface 50 of the housing, and extends parallel along the length of the dispenser. The slot 48 includes at least one section having an enlarged or cut-out opening 52 that is positioned at one end of the slot. The enlarged opening 52 serves to facilitate passage of the folded up rolling strip through the slot when the cigarette rolling paper is pulled therethrough. In a preferred embodiment, the enlarged opening 52 is rectangular in shape and extends symmetrically in opposite directions away from the slot.

To increase the number of cigarette rolling papers packaged and stored within the dispenser, it is desired that each paper be stacked one on top of another in a staggered arrangement so that the position of the folded rolling strip is evenly distributed between opposite ends of the dispenser. In such an embodiment, is desired that the dispenser slot 48 include two enlarged openings 52, one at each end of the slot, to facilitate release of the folded rolling strip of each staggered paper through the slit.

Another key feature of cigarette rolling papers constructed according to principles of this invention is that the rolled rolling strip, after being used to assist in forming a cylindrical cigarette, acts as a filter to minimize or eliminate the passage of smoking material through the cigarette and into a user's mouth during smoking. The spiraled configuration of the rolled rolling strip forms a continuous spiral-shaped channel, if viewed in cross section, having a narrow channel opening defined by opposing frontside and backside rolling strip surfaces. The narrow channel opening serves to minimize or prevent the passage of smoking material therethrough when the cigarette is being smoked. Accordingly, the rolling strip may also properly be referred to as a filter/rolling strip.

Another key feature of cigarette rolling papers constructed according to principles of this invention is that the rolled rolling strip allows for the consumption of the entire amount of the smoking material. Unlike cigarettes formed from conventional cigarette papers, a user smoking a cigarette formed from cigarette rolling papers of this invention is able to consume the entire amount of smoking material without the need to use external devices, such as clips and the like, and without the risk of burned fingers or lips. The rolled rolling strip acts to insulate the smokers lips and fingers from the combustible smoking material.

The foregoing description of presently preferred and other aspects of this invention has been presented by way of illustration and example. It does not present, nor is it intended to present, an exhaustive catalog of all structural and procedural forms by which the invention can be embodied. Variations upon and alterations of the described structures and procedures can be pursued without departing from the fair substance and scope of the invention consistent with the foregoing descriptions, and the following claims which are to be read and interpreted liberally in the context of the state of the art from which this invention has advanced.

What is claimed is:

1. A cigarette rolling paper comprising:

a rectangular sheet of cigarette paper having a frontside surface and a backside surface; and a rectangular strip of material attached at one end along the frontside surface of the sheet between opposed lengthwise and widthwise edges of the sheet, wherein the strip is attached so that it extends lengthwise along a width of the sheet, wherein a lengthwise edge of the strip is positioned adjacent a widthwise edge of the sheet, and wherein the strip is adapted to be rolled upon itself and contained within the cigarette paper for facilitating rolling the cigarette paper into a cylinder.

2. A cigarette rolling paper as recited in claim 1 wherein the strip is attached to the sheet between a first lengthwise edge of the sheet and a midpoint of the sheet width.

3. A cigarette rolling paper as recited in claim 2 wherein the strip includes a free end opposite from the end attached to the sheet, and wherein the free end extends a distance beyond a second lengthwise edge of the sheet that is opposite to the first lengthwise edge.

4. A cigarette rolling paper as recited in claim 3 wherein the free end of the strip extends beyond the second lengthwise edge of the sheet a distance in the range of from 0.1 to 1 inches.

5. A cigarette rolling paper as recited in claim 1 wherein the strip includes lengthwise edges that are tapered inwardly toward one another moving toward a nonattached end.

6. A cigarette rolling paper as recited in claim 1 wherein the strip has a width that is less than one half of the length of the sheet.

7. A cigarette rolling paper comprising:

a rectangular sheet of cigarette paper having a frontside surface and a backside surface, wherein the sheet includes an adhesive section extending along a first lengthwise edge of the frontside surface; and a rectangular strip of material attached at one of its ends along the frontside surface of the sheet between respective opposing lengthwise and widthwise edges of the sheet, wherein the strip extends lengthwise along a width of the sheet and has a lengthwise edge that is positioned adjacent a widthwise edge of the sheet, wherein the strip includes a free end that extends a distance beyond a second lengthwise edge of the sheet opposite the first lengthwise edge, and wherein the strip is adapted to be rolled upon itself for placement within the cigarette paper to facilitate rolling the cigarette paper into a cylinder.

8. A cigarette rolling paper as recited in claim 7 wherein the strip is attached along the frontside surface of the sheet at a position between the first lengthwise edge of the sheet and a midpoint of the sheet width.

9. A cigarette rolling paper as recited in claim 8 wherein the strip has a width that is less than one half of the length of the sheet.

10. A cigarette rolling paper as recited in claim 9 wherein the strip includes lengthwise edges that are tapered inwardly toward one another moving toward the free end.

11. A cigarette rolling paper comprising:

a rectangular sheet of cigarette paper having a frontside surface and a backside surface, wherein the sheet includes an adhesive section extending along a first lengthwise edge of the frontside surface; and a rectangular strip of material attached at one of its widthwise ends to the frontside surface, wherein the strip is positioned between opposing widthwise edges of the sheet and between the adhesive section and a midpoint between opposed lengthwise edges of the sheet, wherein the strip includes a lengthwise edge that is positioned adjacent a widthwise edge of the sheet, and wherein the strip is adapted to be rolled upon itself and surrounded by the frontside surface of the cigarette paper for facilitating rolling the cigarette in to a cylinder.

* * * * *